US007032362B2

(12) United States Patent
Dierl et al.

(10) Patent No.: US 7,032,362 B2
(45) **Date of Patent: *Apr. 25, 2006**

(54) VERTICAL STAND-UP POUCH WITH INTEGRATED RECLOSE STRIP

(75) Inventors: Martin Bernhard Dierl, Allen, TX (US); Jay Edward Gehring, Frisco, TX (US); Anthony Robert Knoerzer, Plano, TX (US); Garrett William Kohl, Allen, TX (US); Steven Kenneth Tucker, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 171 days.

This patent is subject to a terminal disclaimer.

(21) Appl. No.: 10/696,982

(22) Filed: Oct. 30, 2003

(65) Prior Publication Data

US 2004/0091183 A1 May 13, 2004

Related U.S. Application Data

(63) Continuation-in-part of application No. 10/100,370, filed on Mar. 18, 2002, now Pat. No. 6,722,106.

(51) Int. Cl.
*B65B 9/20* (2006.01)
*B65B 61/00* (2006.01)

(52) U.S. Cl. ..... 53/410; 53/451

(58) Field of Classification Search ..... 53/133.4, 53/139.2, 412, 451, 551, 552, 410
See application file for complete search history.

(56) References Cited

U.S. PATENT DOCUMENTS 3,537,636 A 11/1970 Rochette
3,785,112 A 1/1974 Leasure et al.
3,785,636 A 1/1974 Bitting et al.
4,194,438 A 3/1980 Schmachtel (Continued)

FOREIGN PATENT DOCUMENTS

GB DES. 2101909 5/2001

(Continued)

*Primary Examiner*—John Sipos
(74) *Attorney, Agent, or Firm*—Jeffrey G. Degenfelder; Colin P. Cahoon; Carstens & Cahoon, LLP

(57) ABSTRACT

A vertical stand-up pouch or flexible package having an integrated reclose strip, and method for manufacturing same, constructed by modification to existing vertical form and fill packaging machines. The modified machine includes a crease-forming mechanism and an apparatus for applying a reclose strip to the sheet of material. The apparatus for applying a reclose strip is incorporated into the mechanism which supplies the continuous sheet of packaging material to the vertical form, fill, and seal machine. The invention involves producing a vertical stand-up pouch having an integrated reclose strip from a single sheet of packaging film by creating a vertical crease along one edge of a packaging film tube prior to forming a transverse seal on the tube. Said vertical crease is formed using a stationary tucker bar positioned outside the packaging film tube and between two forming plates positioned inside the packaging film tube. The reclose strip is attached along the longitudinal axis of the sheet of packaging material prior to forming the sheet into a tube in the conventional manner. The reclose strip includes a peel strip which is removable to allow the package, when opened, to be folded down and sealed against an adhesive which will be exposed upon the removal of the peel strip. In a preferred embodiment, the reclose strip comprises a length of two-sided adhesive tape.

4 Claims, 11 Drawing Sheets

U.S. PATENT DOCUMENTS

| | | | | |
|---|---|---|---|---|
| 4,597,103 | A | 6/1986 | Hoover | |
| 4,604,854 | A | 8/1986 | Andreas | |
| 4,894,975 | A | 1/1990 | Ausnit | |
| 4,913,561 | A | 4/1990 | Beer | |
| 4,925,438 | A | 5/1990 | Wagner | |
| 4,986,054 | A | 1/1991 | McMahon | |
| 5,030,190 | A | 7/1991 | Woods et al. | |
| 5,046,300 | A | 9/1991 | Custer et al. | |
| 5,127,208 | A | 7/1992 | Custer et al. | |
| 5,170,608 | A | 12/1992 | Petry et al. | |
| 5,242,516 | A | 9/1993 | Custer et al. | |
| 5,322,579 | A | 6/1994 | Van Erden | |
| 5,398,486 | A | 3/1995 | Kauss et al. | |
| 5,400,565 | A | 3/1995 | Terminella et al. | |
| RE34,905 | E | 4/1995 | Ausnit | |
| 5,412,924 | A | 5/1995 | Ausnit | |
| 5,425,215 | A | 6/1995 | Ausnit | |
| 5,505,037 | A | 4/1996 | Terminella et al. | |
| 5,551,208 | A | 9/1996 | Van Erden | |
| 5,561,966 | A | 10/1996 | English | |
| 5,564,259 | A | 10/1996 | Stolmeier | |
| 5,590,783 | A | 1/1997 | Capy et al. | |
| 5,746,043 | A | 5/1998 | Terminella et al. | |
| 5,768,852 | A | 6/1998 | Terminella et al. | |
| 5,768,969 | A | 6/1998 | Dalfiume | |
| 5,862,652 | A | 1/1999 | Schoeler | |
| 5,930,983 | A | 8/1999 | Terminella et al. | |
| 6,029,428 | A | 2/2000 | Terminella et al. | |
| 6,047,521 | A | 4/2000 | Terminella et al. | |
| 6,145,282 | A | 11/2000 | Tsuruta | |
| 6,279,298 | B1 * | 8/2001 | Thomas et al. | 53/412 |
| 6,398,412 | B1 | 6/2002 | Wedi et al. | |
| 6,481,183 | B1 * | 11/2002 | Schmidt | 53/412 |
| 6,615,567 | B1 | 9/2003 | Kuhn et al. | |
| 6,729,109 | B1 * | 5/2004 | Knoerzer et al. | 53/451 |
| 2003/0009989 | A1 | 1/2003 | Knoerzer et al. | |

FOREIGN PATENT DOCUMENTS

| | | |
|---|---|---|
| JP | 2191159 | 7/1990 |
| WO | PCT/FR93/00303 | 10/1993 |

* cited by examiner

FIG. 3a
(PRIOR ART)
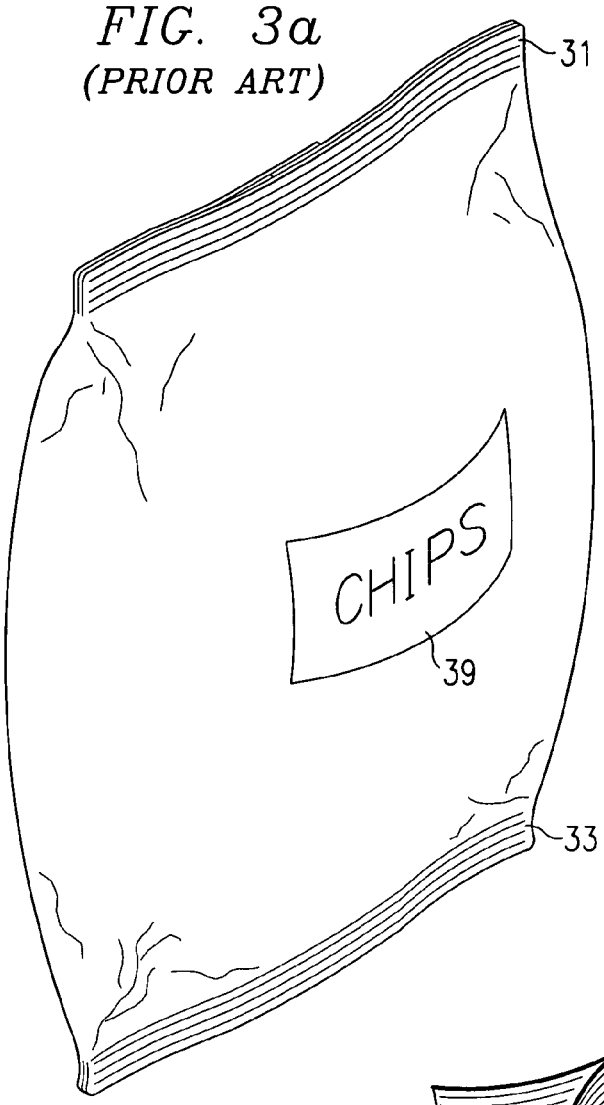
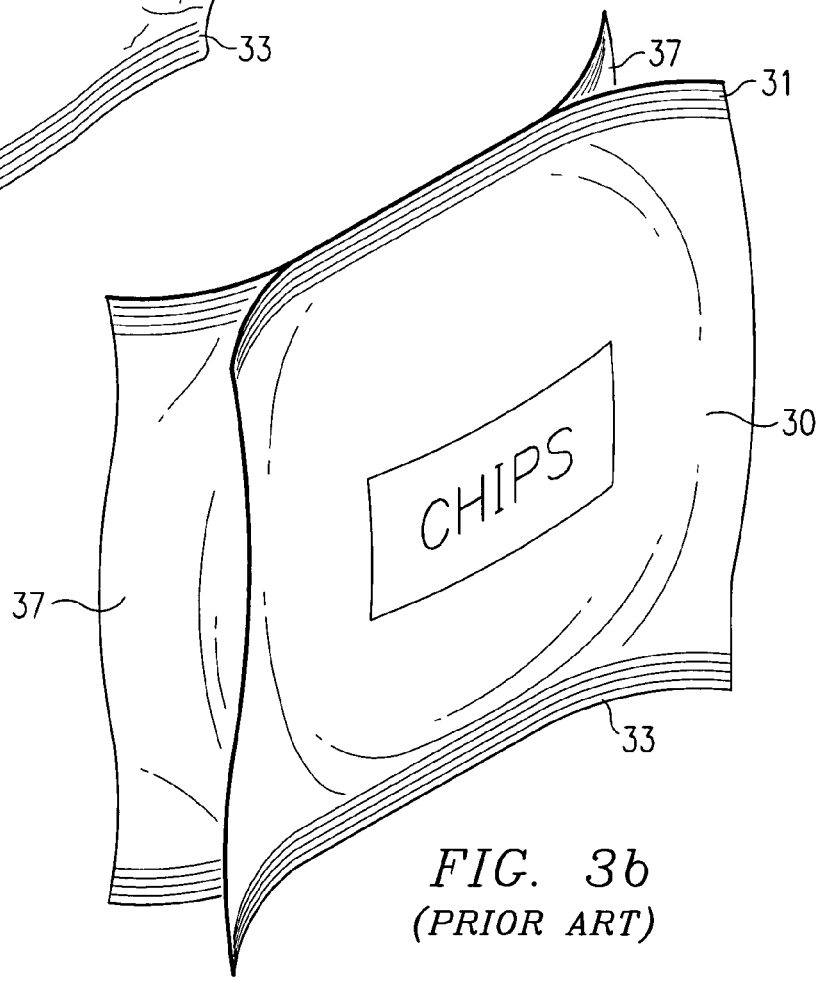
FIG. 3b
(PRIOR ART)

FIG. 13c
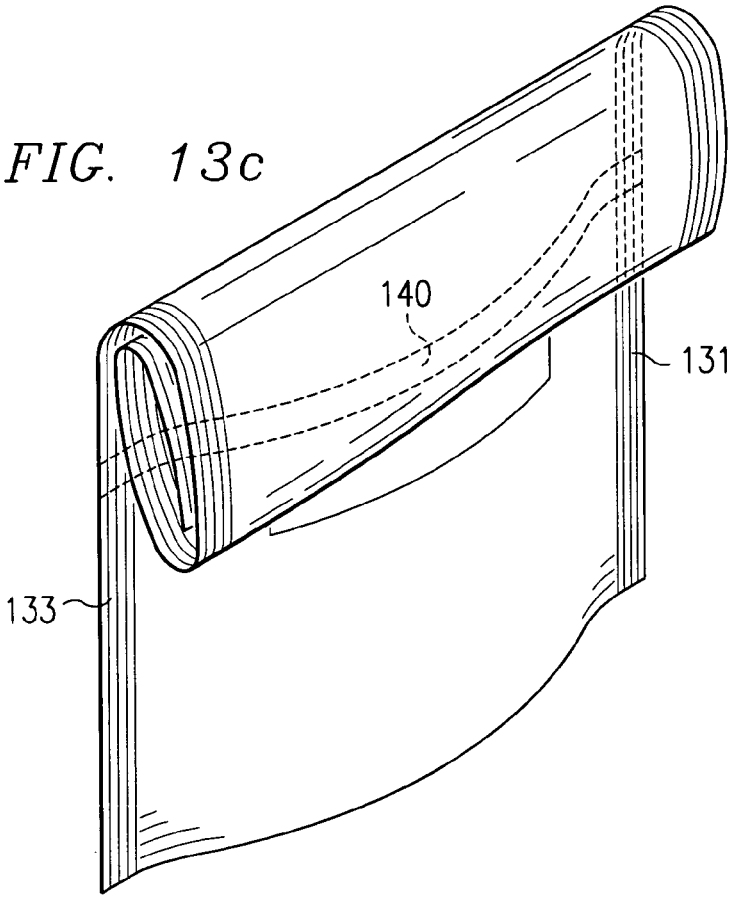
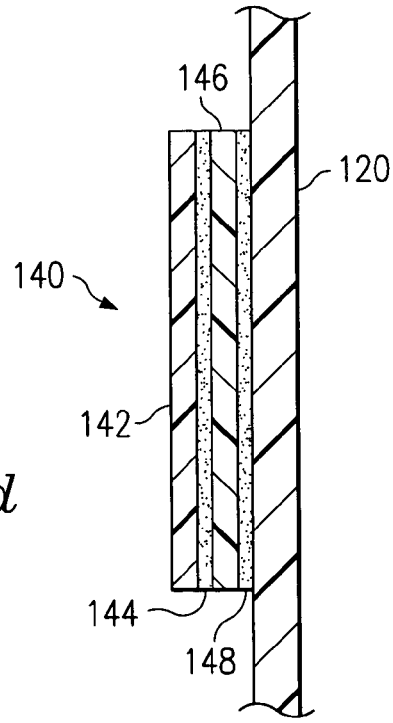
FIG. 13d

VERTICAL STAND-UP POUCH WITH INTEGRATED RECLOSE STRIP

CROSS-REFERENCE TO RELATED APPLICATION

This application is a continuation-in-part of U.S. patent application Ser. No. 10/100,370, filed on Mar. 18, 2002 now U.S. Pat. No. 6,722,106, the technical disclosure of which is hereby incorporated herein by reference.

BACKGROUND OF THE INVENTION

1. Technical Field

The present invention relates to a vertical stand-up pouch having an integrated reclose strip constructed using a modified vertical form and fill packaging machine, and the method for making same, that provides for a single piece construction of a vertical stand-up bag suitable for retail snack food distribution. The invention allows for use of existing film converter and packaging technology to produce a stand-up package for moisture sensitive food products or the like with minimal increased costs and minimal modification. The resulting stand-up package may be opened, a part of the contents removed and the package resealed to prevent premature deterioration of the quality of the contents because of exposure to moisture in the air.

2. Description of Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting across the sealed area.

The packaging film used in such process is typically a composite polymer material produced by a film converter. For example, one prior art composite film used for packaging potato chips and like products is illustrated in FIG. 1, which is a schematic of a cross-section of the film illustrating each individual substantive layer. FIG. 1 shows a sealable inside, or product side, layer 16 which typically comprises metalized oriented polypropylene ("OPP") or metalized polyethylene terephtalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

The prior art film composition shown in FIG. 1 is ideally suited for use on vertical form and fill machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package.

Typical back seals formed using the film composition shown in FIG. 1 are illustrated in FIGS. 2*a* and 2*b*. FIG. 2*a* is a schematic of a "lap seal" embodiment of a back seal being formed on a tube of film. FIG. 2*b* illustrates a "fin seal" embodiment of a back seal being formed on a tube of film.

With reference to FIG. 2*a*, a portion of the inside metalized layer 26 is mated with a portion of the outside layer 20 in the area indicated by the arrows to form a lap seal. The seal in this area is accomplished by applying heat and pressure to the film in such area. The lap seal design shown in FIG. 2*a* insures that the product to be placed inside the formed package will be protected from the ink layer by the metalized inside layer 26.

The fin seal variation shown in FIG. 2*b* also provides that the product to be placed in the formed package will be protected from the ink layer by the metalized inside layer 26. Again, the outside layer 20 does not contact any product. In the embodiment shown in FIG. 2*b*, however, the inside layer 26 is folded over and then sealed on itself in the area indicated by the arrows. Again, this seal is accomplished by the application of heat and pressure to the film in the area illustrated.

Regardless of whether a lap seal or fin seal is used for constructing a standard package using a vertical form, fill, and seal packaging machine, the end result is a package as shown in FIG. 3*a* with horizontally oriented top and bottom transverse seals 31, 33. Such package is referred to in the art as a "vertical flex bag" or "pillow pouch," and is commonly used for packaging snack foods such as potato chips, tortilla chips, and other various sheeted and extruded products. The back seal discussed with reference to FIGS. 2*a* and 2*b* runs vertically along the bag and is typically centered on the back of the package shown in FIG. 3*a*, thus not visible in FIG. 3*a*. Because of the narrow, single edge base on the package shown in FIG. 3*a* formed by the bottom transverse seal 33, such prior art packages are not particularly stable when standing on one end. This shortcoming has been addressed in the packaging industry by the development of a horizontal stand-up pouch such as the embodiment illustrated in FIGS. 4*a*, 4*b*, and 4*c*. As can be seen by reference to said Figures, such a horizontal stand-up pouch has a relatively broad and flat base 47 having two contact edges. This allows for the pouch to rest on this base 47 in a vertical presentation. Manufacture of such horizontal stand-up pouches, however, does not involve the use of standard vertical form, fill, and seal machines but, rather, involves an expensive and relatively slow 3-piece construction using a pouch form, fill, and seal machine.

Referring to FIGS. 4*b* and 4*c*, the horizontal stand-up pouch of the prior art is constructed of three separate pieces of film that are mated together, namely, a front sheet 41, a rear sheet 43, and a base sheet 45. The front sheet 41 and rear sheet 43 are sealed against each other around their edges, typically by heat sealing. The base sheet 45 is, however, first secured along its outer edges to the outer edges of the bottom of the front sheet 41 and rear sheet 43, as is best illustrated in FIG. 4*c*. Likewise, the mating of the base sheet 45 to the front sheet 41 and the rear sheet 43 is also accomplished typically by a heat seal. The requirement that such horizontal stand-up pouch be constructed ofthree pieces results in a package that is significantly more expensive to construct than a standard form, fill, and seal vertical flex bag.

Further disadvantages of using horizontal stand-up pouches include the initial capital expense of the horizontal stand-up pouch machines, the additional gas flush volume required during packaging as compared to a vertical flex bag, increased down time to change the bag size, slower bag forming speed, and a decreased bag size range. For example, a Polaris model vertical form, fill, and seal machine manufactured by Klick Lock Woodman of Georgia, USA, with a volume capacity of 60–100 bags per minute costs in the range of $75,000.00 per machine. A typical horizontal stand-up pouch manufacturing machine manufactured by Roberts Packaging of Battle Creek, Mich., with a bag capacity of 40–60 bags per minute typically costs $500,000.00. The film cost for a standard vertical form, fill, and seal package is approximately $0.04 per bag with a comparable horizontal stand-up pouch costing roughly twice as much. Horizontal stand-up pouches further require more than twice the oxygen or nitrogen gas flush. Changing the bag size on a horizontal stand-up pouch further takes in excess of two hours, typically, while a vertical form and fill machine bag size can be changed in a matter of minutes. Also, the typical bag size range on a horizontal stand-up pouch machine is from 4 oz. to 10 oz., while a vertical form and fill machine can typically make bags in the size range of 1 oz. to 24 oz.

One advantage of a horizontal stand-up pouch machine over a vertical form, fill, and seal machine, however, is the relatively simple additional step of adding a reclosable seal or a zipper seal at the top of the bag for reclosing of the bag. Vertical form, fill, and seal machines typically require substantial modification and/or the use of reclosable or zipper seals premounted on the film oriented horizontally to the seal facings used to seal the horizontal transverse seals.

For example, U.S. Pat. No. 4,584,201 to Boston discloses a system for applying a segment of seal strip to the external surface of a bag manufactured using a vertical form, fill, and seal machine, such that, when it is desired, the bag may be closed (i.e., resealed) after it has been opened. According to the Boston '201 disclosure, the seal strip includes a peel strip which is removable to allow the package, when opened, to be folded down and sealed against an adhesive which will be exposed upon the removal of the peel strip. In accordance with the Boston '201 disclosure, the bag is typically folded a plurality of times in the direction of the seal strip and the external surface of the bag is applied to an exposed adhesive on the seal strip and thereby the bag is resealed for storage of the contents. However, the Boston '201 invention necessitate the precise placement of discrete segments of seal strip across the traverse of the sheet of packaging material such that the applied seal strip is positioned parallel to the top traverse seal on the resulting bag and perpendicular to the vertical back seal. While effective, the Boston '201 system is unduly complex. Moreover, the Boston '201 system is only directed at and adapted for the production of conventional vertical flex bags or pillow pouches.

An alternative approach taken in the prior art to producing a bag with more of a stand-up presentation is the construction of a flat bottom bag such as illustrated in FIG. 3*b*. Such a bag is constructed in a method very similar to that described above with regard to prior art pillow pouches. However, in order to form the vertical gussets 37 on either side of the bag, the vertical form, fill, and seal machine must be substantially modified by the addition of two movable devices on opposite sides of the sealing carriage that move in and out to make contact with the packaging film tube in order to form the tuck that becomes the gussets 37 shown in FIG. 3*b*. Specifically, when a tube is pushed down to form the next bag, two triangular shaped devices are moved horizontally towards the packaging film tube until two vertical tucks are formed on the packaging film tube above the transverse seals by virtue of contact with these moving triangular shaped devices. While the two triangular shaped devices are thus in contact with the packaging tube, the bottom transverse seal is formed. The package is constructed with an outer layer 30 that is non-sealable, such as paper. This causes the formation of a V-shaped gusset 37 along each vertical edge of the package when the transverse seals 31, 33 are formed. While the triangular shaped devices are still in contact with the tube of packaging material, the product is dropped through the forming tube into the tube of packaging film that is sealed at one end by virtue of the lower transverse seal 33. The triangular shaped devices are then removed from contact with the tube of packaging film and the film is pushed down for the formation of the next package. The process is repeated such that the lower transverse seal 33 of the package above and upper transverse seal 31 of the package below are then formed. This transverse seal is then cut, thereby releasing a formed and filled package from the machine having the distinctive vertical gussets 37 shown in FIG. 3*b*.

The prior art method described above forms a package with a relatively broad base due to the V-shaped vertical gussets 37. Consequently, it is commonly referred to in the art as a flat bottom bag. Such flat bottom bag is advantageous over the previously described horizontal stand-up pouch in that it is formed on a vertical form, fill, and seal machine, albeit with major modifications. However, the prior art method of making a flat bottom bag has a number of significant drawbacks. For example, the capital expense for modifying the vertical form, fill, and seal machine to include the moving triangular-shaped devices is approximately $30,000.00 per machine. The changeover time to convert a vertical form, fill, and seal machine from a standard pillow pouch configuration to a stand-up bag configuration can be substantial, and generally in the neighborhood of one-quarter man hours. The addition of all of the moving parts required for the triangular-shaped devices to move in and out of position during each package formation cycle also adds complexity to the vertical form, fill, and seal machine, inevitably resulting in maintenance issues. Importantly, the vertical form, fill, and seal machine modified to include the moving triangular-shaped devices is significantly slower than a vertical form, fill, and seal machine without such devices because of these moving components that form the vertical gussets. For example, in the formation of a six inch by nine inch bag, the maximum run speed for a modified vertical form, fill, and seal machine using the triangular-shaped moving devices is in the range of 15 to 20 bags per minute. A standard vertical form, fill, and seal machine without such modification can construct a similarly sized pillow pouch at the rate of approximately 40 bags per minute.

Consequently, a need exists for a method to form a stand-up pouch, similar in appearance and functionality to the prior art horizontal stand-up pouches, using vertical form, fill, and seal machine technology and a single sheet of packaging film. Moreover, a need also exists for a simpler method of incorporating a reclosable strip into such a formed stand-up pouch using the vertical form, fill, and seal machine technology. This method should allow for reduced film cost per bag as compared to horizontal stand-up pouches, ease in size change, little capital outlay, and the ability to easily add a zipper seal to the bags, all while maintaining bag forming speeds typical of vertical form, fill, and seal machine pillow pouch production. Such method should ideally produce a vertical stand-up pouch having an integrated reclose strip, and constructed of material commonly used to form standard vertical flex bags.

SUMMARY OF THE INVENTION

The proposed invention involves producing a vertical stand-up pouch or package having an integrated reclose strip, and constructed of a single sheet of packaging material using a slightly modified vertical form, fill, and seal machine. The modified machine includes a crease-forming mechanism and an apparatus for applying a reclose strip to the sheet of material. The crease-forming mechanism includes a tension bar and forming plates located below the forming tube and a stationary but adjustable tucker mechanism mounted to the frame of the machine which, when positioned between the two forming plates, creates a vertical tuck along the length of the package while it is being formed. The apparatus for applying a reclose strip is incorporated into the mechanism which supplies the continuous sheet of packaging material to the vertical form, fill, and seal machine. The reclose strip is attached along the longitudinal axis of the sheet of packaging material prior to forming the sheet into a tube in the conventional manner. The reclose strip includes a peel strip which is removable to allow the package, when opened, to be folded down and sealed against an adhesive which will be exposed upon the removal of the peel strip. In a preferred embodiment, the reclose strip comprises a length of two-sided adhesive tape.

The graphics on the packages are oriented 90° from a standard presentation such that the tuck forms the bottom of the package. The reclose strip can be easily added to the manufacture of such a vertical stand-up package since the reclose strip, which is attached along the longitudinal axis of the sheet of packaging material, can accompany the single sheet of packaging film through a vertical form, fill, and seal machine in the conventional manner. The transverse seals on the formed package are therefore oriented vertically and the reclose strip is oriented horizontally when the package is placed on display. Thus, when opened, the top of the package can be double folded and pressed against the exposed adhesive strip thereby providing a reclosable seal feature.

The method disclosed and the package formed as a consequence is a substantial improvement over prior art horizontal stand-up pouches or packages and flat bottom bags. The method works on existing vertical form, fill, and seal machines requiring very little modification. There are no substantial moving parts or jaw carriage modifications involved with the crease-forming mechanism. Moreover, the apparatus for applying the reclose strip may be easily incorporated into the supply mechanism that supplies the continuous sheet of packaging material to the vertical form, fill, and seal machine.

The modified vertical form, fill, and seal machines can also be easily converted back to a conventional pillow pouch configuration by selectively disengaging the crease-forming mechanism and discontinuing the supply of reclose strip. The same metalized or clear laminations used as materials in pillow pouches can also be used with the invention therefore saving in per bag cost. The invention allows for the formation of bags that emulate a horizontal stand-up pouch using a completely different method that takes advantage of the economics of vertical form and fill machine technology.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 3*a* is a perspective view of a prior art vertical flex bag;

FIG. 3*b* is a perspective view of a prior art flat bottom bag;

FIG. 13*c* is a perspective view of the vertical stand-up package having an integrated reclose strip shown in FIGS. 13*a* and 13*b* that has been opened and subsequently folded over to reseal the top in accordance with the present invention; and FIG. 13*d* is a fragmentary sectional view taken along line 13*d*—13*d* of FIG. 13*a*.

Figure 1:
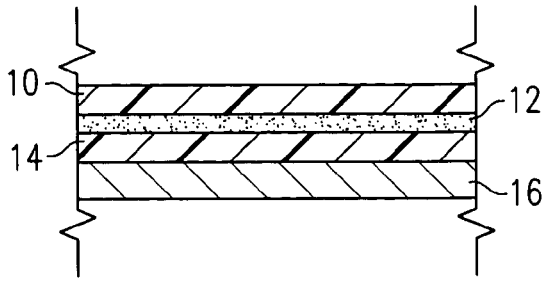
FIG. 1 (PRIOR ART)
FIG. 1 is a schematic cross-section views of prior art packaging films.
Figure 2A:
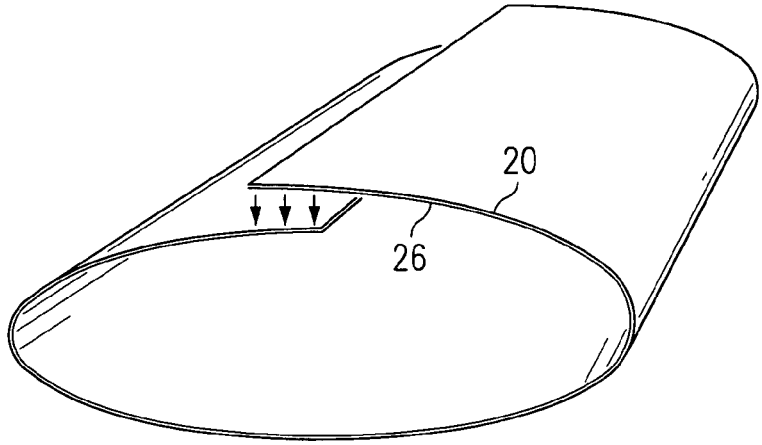
FIG. 2a (PRIOR ART)
FIG. 2*a* is a schematic cross-section view of a tube of packaging film illustrating the formation of a prior art lap seal.
Figure 2B:
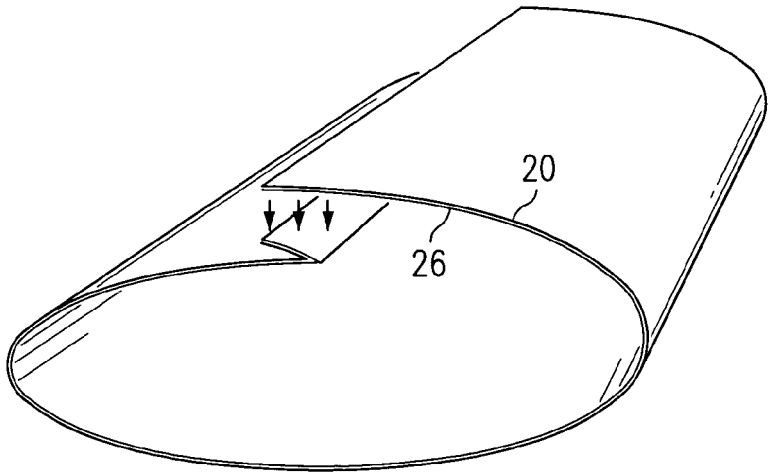
FIG. 2b (PRIOR ART)
FIG. 2*b* is a schematic cross-section of a tube of packaging film illustrating the formation of a prior art fin seal.
Figure 4A:
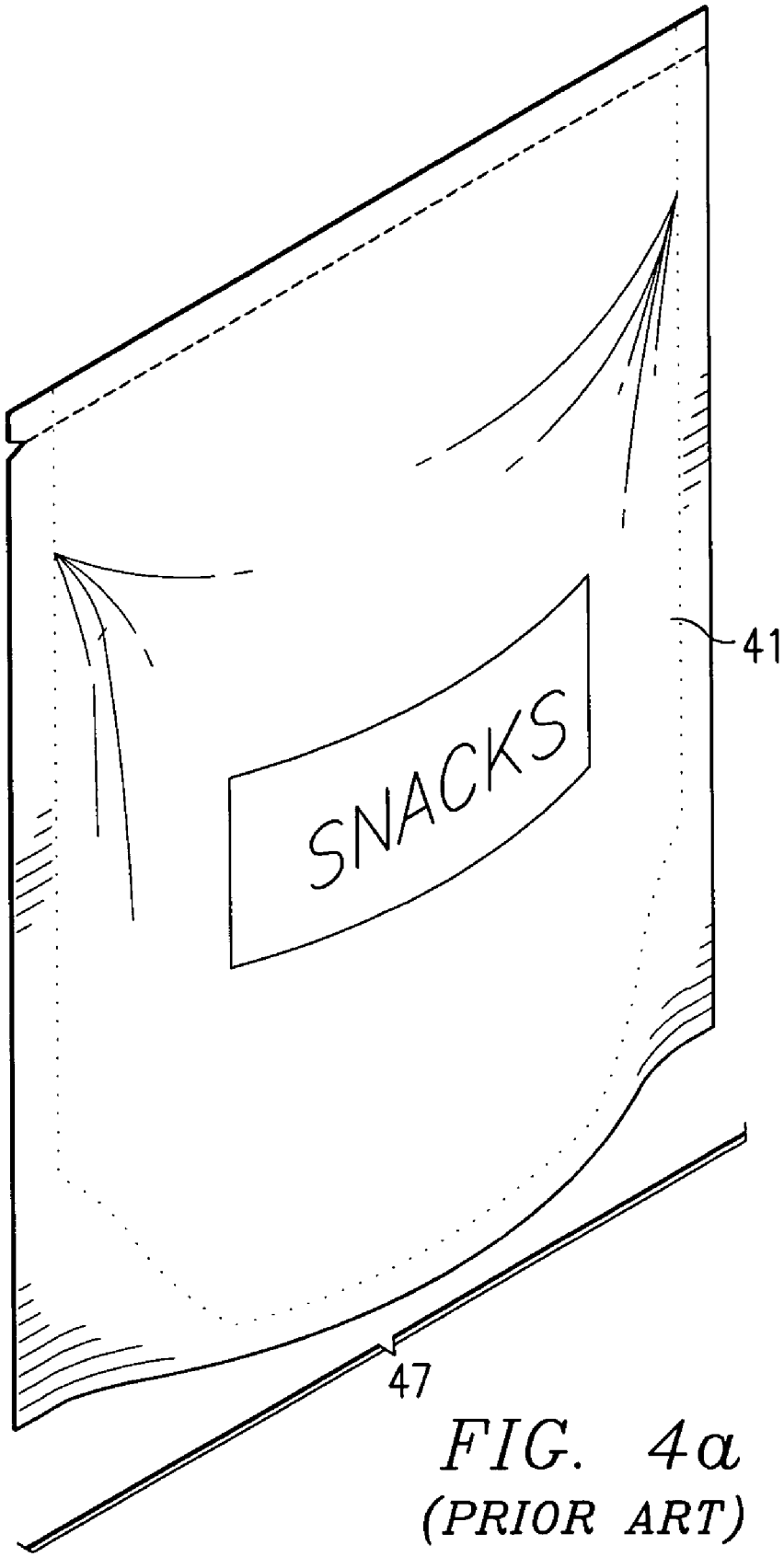
FIG. 4a (PRIOR ART)
FIGS. 4*a*, 4*b*, and 4*c* are perspective views in elevation of a prior art horizontal stand-up pouch.
Figure 4B:
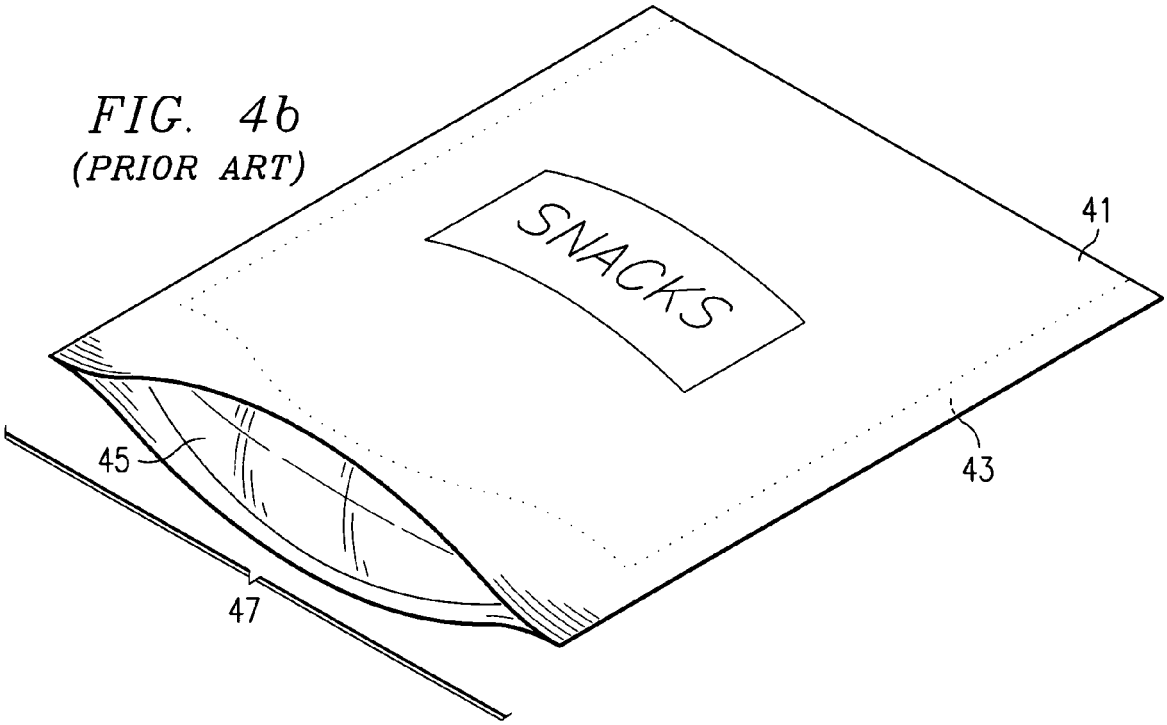
FIG. 4b (PRIOR ART)
Figure 4C:
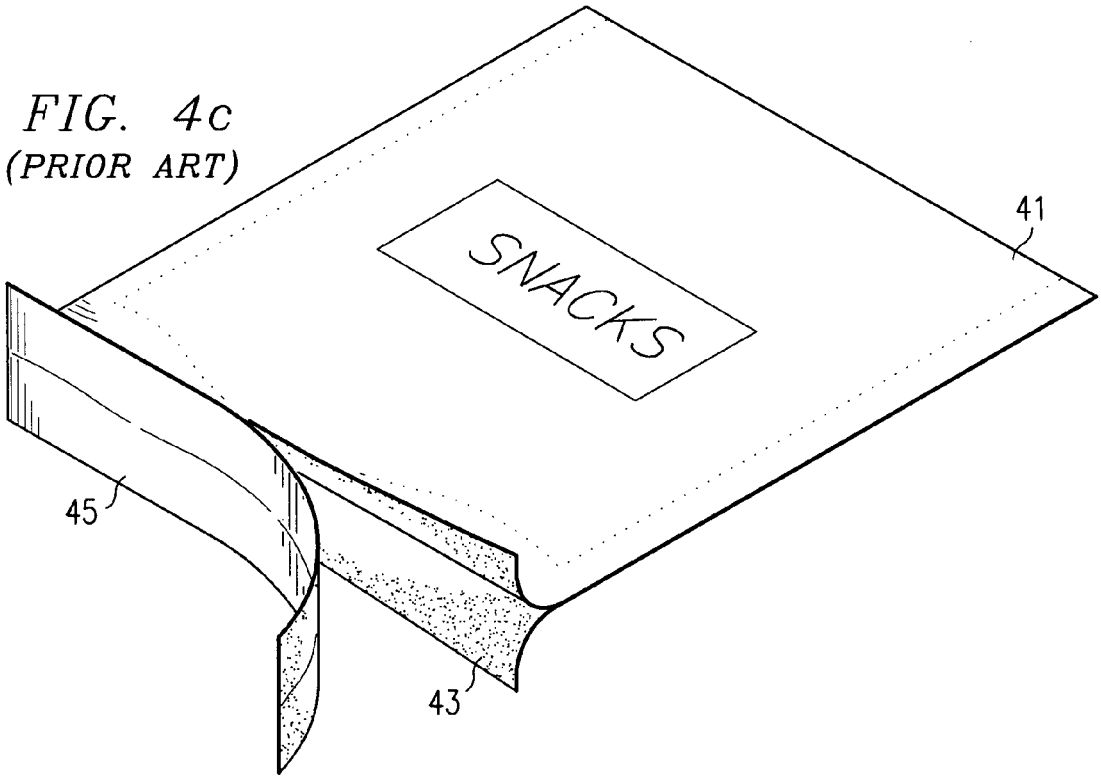
FIG. 4c (PRIOR ART)

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION

Figure 5:
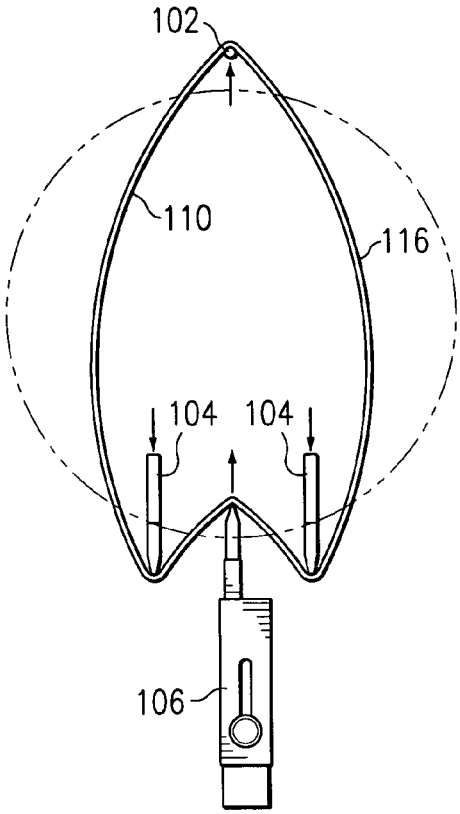
FIG. 5 is a schematic cross-section of a tube of packaging film formed by the present invention methods.
Figure 6:
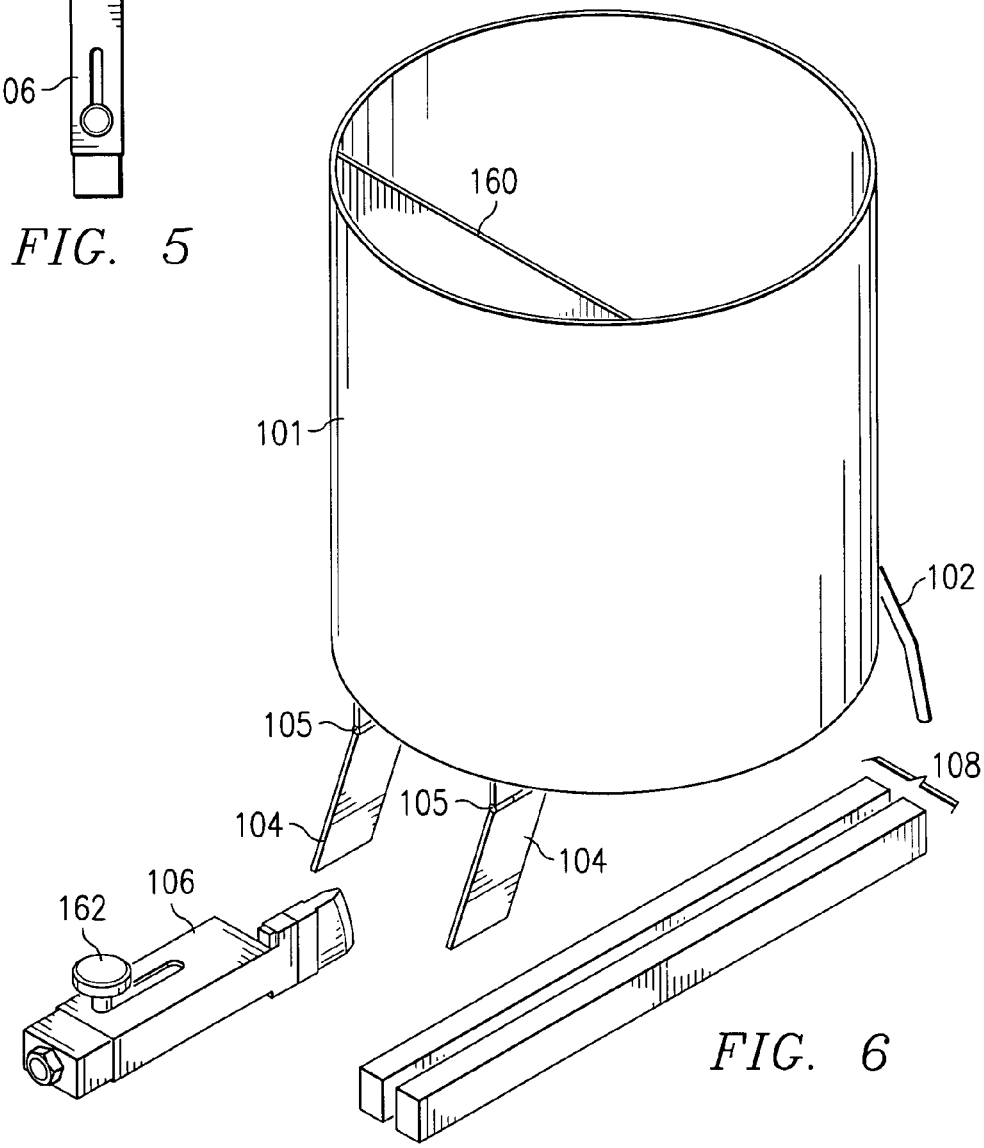
FIG. 6 is a perspective view of the tucker mechanism, forming plates, and tension bar in elevation of the present invention in relation to a forming tube and sealing jaws of a vertical form and fill machine.

FIGS. 5 and 6 illustrate the basic components used with the method of the proposed invention. The same reference numbers are used to identify the same corresponding elements throughout all drawings unless otherwise noted. FIG. 5 is a schematic cross-section of a tube of packaging material (film) formed by the present invention method. The tube of packaging film shown in FIG. 5 is illustrated as a cross-sectional area immediately below the forming tube 101 of FIG. 6. The tube of packaging film comprises an outer layer 116 and an inner layer 110, and can comprise material typically used in the field of art for making a standard vertical flex bag, such as discussed in relation to FIG. 1. The tube in FIG. 5 has been formed by sealing one sheet of film with a vertical back seal, as previously described with regard to discussions of prior art vertical form and fill machine methods.

FIG. 6 shows a forming tube 101 typical in most respects to those used with prior art vertical form, fill, and seal machines. This forming tube 101 can be a cylinder, have a rectangular cross section, or any number of shapes, but is preferably cylindrical as illustrated. The film illustrated in FIG. 5 is initially formed around the forming tube 101 of FIG. 6. This forming tube 101 is shown in elevation but would normally be integrally attached to the vertical form, fill, and seal machine. Also shown in FIG. 6 are a pair of prior art sealing jaws 108 likewise illustrated in elevation. Not shown in FIG. 6 is the sealing jaw carriage on which such sealing jaws 108 would be mounted below the forming tube 101.

As previously described, the practice in the prior art in the manufacture of a vertical flex bag involves feeding a continuous packaging film directed around the forming tube 101. A back seal is formed on a single layer of film in order to create a tube of film around the forming tube 101. The seal jaws 108 close on the thus formed tube of packaging film, thereby forming a bottom transverse seal. Product is then dropped through the forming tube 101 into the tube of packaging film. The tube is then driven downward by friction against rotating belts (not shown), and the seal jaws 108 are used to form another transverse seal above the level of the product found inside the tube. This seal is subsequently cut horizontally such that a top transverse seal is formed at the top of the filled bag below and a bottom transverse seal is formed on the tube of packaging film above. The packaging film during the prior art operation described above is oriented perpendicular to the longitudinal translation of the film so as to be readable by an operator of the machine as the film travels down the forming tube 101. This orientation provides graphics 39 on the formed prior art bag that are readable by a consumer when the formed bag is placed on a retail display shelf while resting on its bottom transverse seal 33 as seen in FIG. 3*a*. As will be described in further detail below, the orientation of the graphics on the film packaging for Applicants' invention is 90° off of the prior art orientation, such that the graphics appear sideways as viewed by the operator of the vertical form and fill machine as the film is pulled down the forming tube 101 of FIG. 6. In other words, the graphics on the packaging film are oriented perpendicular to the direction of film travel.

The invention adds three basic components to a prior art vertical form, fill, and seal machine. Two forming plates 104 and one tension bar 102 are used to hold the packaging film tube in tension from inside the tube, as indicated by the arrows illustrated on FIG. 5. As shown in FIG. 6, the forming plates 104 and tension bar 102 can be attached directly to the forming tube 101 or, alternatively, to any supporting structure on the vertical form, fill, and seal machine, as long as the forming plates 104 and tension bar 102 are positioned within the tube of packaging material, below the bottom of the forming tube 101, and above the heat sealing jaws 108.

Tension is applied on the outside of the film and in the opposite direction of the tension provided by the forming plates 104 by a fixed or stationary tucker mechanism 106, alternatively referred to herein as a tucker bar 106, positioned between said forming plates 104. The tucker bar 106 is preferably attached to the sealing carriage for the vertical form, fill, and seal machine and is adjustable along all three axes (in/out, up/down, and front/back). Alternatively, the tucker bar 106 can be attached to the frame of the vertical form, fill, and seal machine or any other point that can supports its function outside the film tube. These adjustments in all three axes allow for the tucker bar 106 to be easily moved out of the way to convert the vertical form and fill machine back to standard operation and is accomplished, in the embodiment shown in FIG. 6, by a tension screw 162 that can lock the tucker bar 106 in place when tightened. While the tucker bar 106 is adjustable, unlike in the prior art, it is fixed or stationary during operation. Therefore, the present invention is a substantial improvement over the art in that there are no moving parts to the tucker mechanism during bag making. This improvement is what Applicants intend to describe when referring to the tucker bar 106 as "stationary" or "fixed." Because of this stationary tucker bar feature, bag making speeds can match typical pillow pouch manufacturing rates.

When moved forward into position (i.e., toward the forming plates 104), the tucker bar 106 provides a crease or fold in the tube of the packaging film between the two forming plates 104. This crease is formed prior to formation of the transverse seal by the seal jaws 108. Consequently, once the transverse seal is formed, the crease becomes an integral feature of one side of the package. The vertical form and fill machine thereafter operates basically as previously described in the prior art, with the sealing jaws 108 forming a lower transverse seal, product being introduced through the forming tube 101 into the sealed tube of packaging film (which now has a crease on one side), and the upper transverse seal being formed, thereby completing the package. The major differences between a prior art package and Applicants' package, however, are that a crease is formed on one side (which later becomes the bottom of the formed package) using the fixed mechanism described and that the graphics on the packaging film used by the invention are oriented such that when the formed package is stood onto the end with the crease, the graphics are readable by a consumer.

Figure 7A:
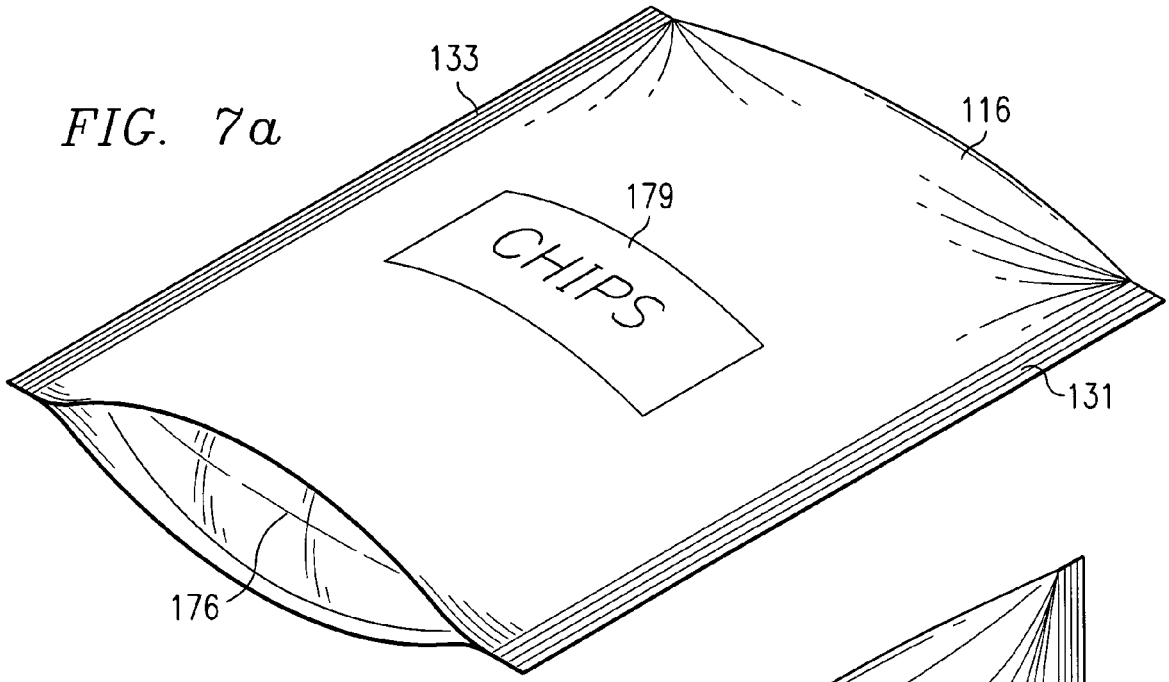
FIGS. 7*a* and 7*b* are perspective views of the vertical stand-up bag of the present invention.
Figure 7B:
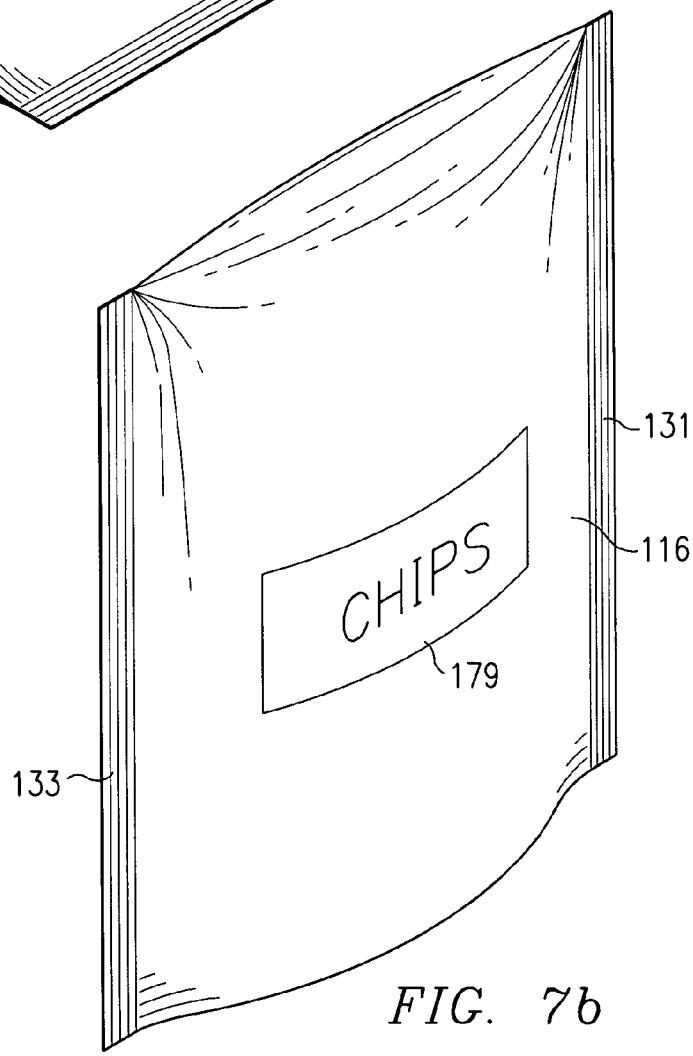

An example of the formed package of the instant invention is shown in FIGS. 7*a* and 7*b*, which show the outside layer of the packaging film 116 with the graphics 179 oriented as previously described. As can be seen from FIGS. 7*a* and 7*b*, the construction of the invention's vertical stand-up pouch shares characteristics with the prior art vertical flex bags shown in FIG. 3*a*. However, the transverse seals 131, 133 of the vertical stand-up bag of the invention are oriented vertically once the bag stands up on one end, as shown in FIG. 7*b*. FIG. 7*a* shows the crease 176 that was formed by the tucker bar 106 and forming plates 104 discussed in relation to FIGS. 5 and 6.

Returning to FIG. 6, another optional feature that can be incorporated into this invention is the use of a diversion plate 160 within the forming tube 101. This diversion plate 160, in the embodiment illustrated, is a flat plate welded vertically inside the forming tube 101 that extends from the bottom of the forming tube 101 to some distance above (for example, at least two or three inches) the bottom of the forming tube 101, where it then is sealed against the inside of the forming tube 101.

The diversion plate 160 in a preferred embodiment accomplishes two functions. First, the diversion plate 160 keeps product that is dropped down the forming tube 101 away from the area where the crease is being formed on the tube of packaging film. Second, the diversion plate 160, can be used as a channel for a gas or nitrogen flush. In such instance, the diversion plate 160 at some point above the bottom of the forming tube 101 seals at the top of the plate 160 against the forming tube 101. Below such seal (not shown) an orifice can be drilled into the forming tube 101 in order to provide gas communication between an exterior gas (for example, nitrogen or oxygen) source and the cavity formed between the diversion plate 160 and the interior of the forming tube 101. The diversion plate 160 as shown in FIG. 6 is a flat plate, but it should be understood that it can be of any variety of shapes, for example, having a curved surface, provided that it accomplishes the functionality of diverting the product away from the area where the tuck is formed on the tube of film.

By using the diversion plate 160 as a channel for the gas flush, the present invention eliminates the need for a separate gas tube to be placed inside the forming tube 101 that normally accomplishes the same function in the prior art. The added benefit of providing a relatively large volume channel formed by the diversion plate 160 and the interior of the forming tube 101 is that a relatively large volume of flushing gas can be introduced into a filled and partially formed package at a significantly lower gas velocity compared to prior art gas tubes. This allows for the filling of packages using this embodiment of the present invention that may contain low weight product that might otherwise be blown back into the forming tube by prior art flushing tubes.

Figure 8:
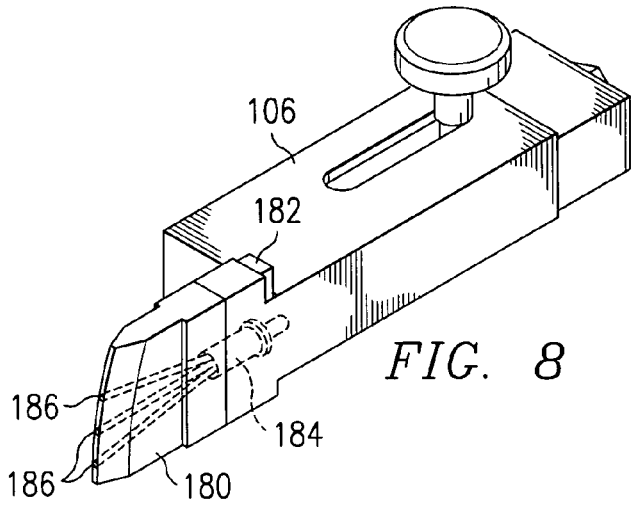
FIG. 8 is a perspective view of one embodiment of the tucker mechanism of the present invention.

FIG. 8 illustrates a preferred embodiment of the tucker bar 106. This embodiment of the tucker bar 106 comprises a head 180 attached to a support 182. Drilled within the support 182 and head 180 is a gas channel 184 shown in phantom on FIG. 8. This gas channel 184 provides a gas communication from an exterior gas source (not shown) through the support 182, through the head 180, and out three orifices 186. The gas channel 184 allows for a metered burst of pressurized gas (typically air) that helps keep the tuck illustrated in FIG. 5 taut throughout the forming and sealing operation without the necessity of moving the tucker bar in and out during bag formation. It should be noted that during operation (bag making) the tucker bar 106 is always stationary. It should further be noted that the head 180 necessarily cannot extend along the entire length of the crease formed by the tucker bar 106 and forming plates 104. Further, it should be understood that when the sealing jaws 108 close onto the tube of film, the lateral dimensions of the tube of film change. All of these facts are compensated for by the use of the pressurized air bursting from the orifices 186. The pressurized air keeps an even amount of pressure on the tuck as it is being formed in the various stages of the forming and sealing process. The air burst can be continuous, but is preferably metered to start as the film for the next bag is being pulled down through the completion of the transverse seal.

The head 180 can comprise any non-stick material but is preferably a fluoropolymer, such as Teflon®. In an alternative embodiment, the tucker bar 106 can comprise one integral piece of metal with the head portion 180 being coated with a fluoropolymer. The curved contact area of the head 180 allows for the continuous formation of the tuck illustrated in FIG. 5 without tearing the packaging film as it is pushed down below the forming tube. While shown with three orifices 186, the head 180 can comprise any number of orifices from one on.

To further compensate for the change in the width of the film tube as the transverse seal is formed by the seal jaws 108 of FIG. 6, it should be noted that the tension bar 102 bends outwardly away from the center of said tube of film along the length of the tension bar 102 and the forming plates 104 are hinged by a horizontal hinge 105. If the tension bar 102 is designed otherwise (e.g., strictly vertical) excess slack occurs in the area of the film tube near the transverse seal. The forming plates 104 comprise horizontal hinges 105 that allow the forming plates to fold inward (i.e., toward each other) slightly while the lower transverse seal is formed. Otherwise, the tube of packaging film would be ripped by the tips of the forming plates 104 during this step.

The present invention offers an economic method of producing a stand-up pouch with numerous advantages over prior art horizontal stand-up pouches and methods for making them. Examples of these advantages are illustrated in Table 1 below.

TABLE 1

| | Current | Commercially Available Horizontal Stand-Up Pouches | Applicants' Vertical Stand-Up Bag |
|---|---|---|---|
| Machine Type | Standard Vertical FFS | Pouch Form, Fill, Seal | Standard Vertical FFS |
| Machine Cost | $75,000.00 | $500,000.00 | $75,000.00 |
| Film Cost | $0.04/bag | $0.08/bag | $0.04/bag |
| Gas Flush | Less than 2% $O_2$ | Only to 5% $O_2$ | Less than 2% $O_2$ |
| Size Change | Easy, change former | 2 hours | Easy, change former |
| Format Change | Flex Bag Only | Stand-Up Pouch Only | Both, simple change |
| Continuous Feed Zipper Option | No | Yes | Yes |
| Bag Size Range in inches | (Width/Height) 5/5 through 14/24 | (Width/Height) 5/5 through 10/12 | (Width/Height) 5/5 through 24/11 |

Figure 9:
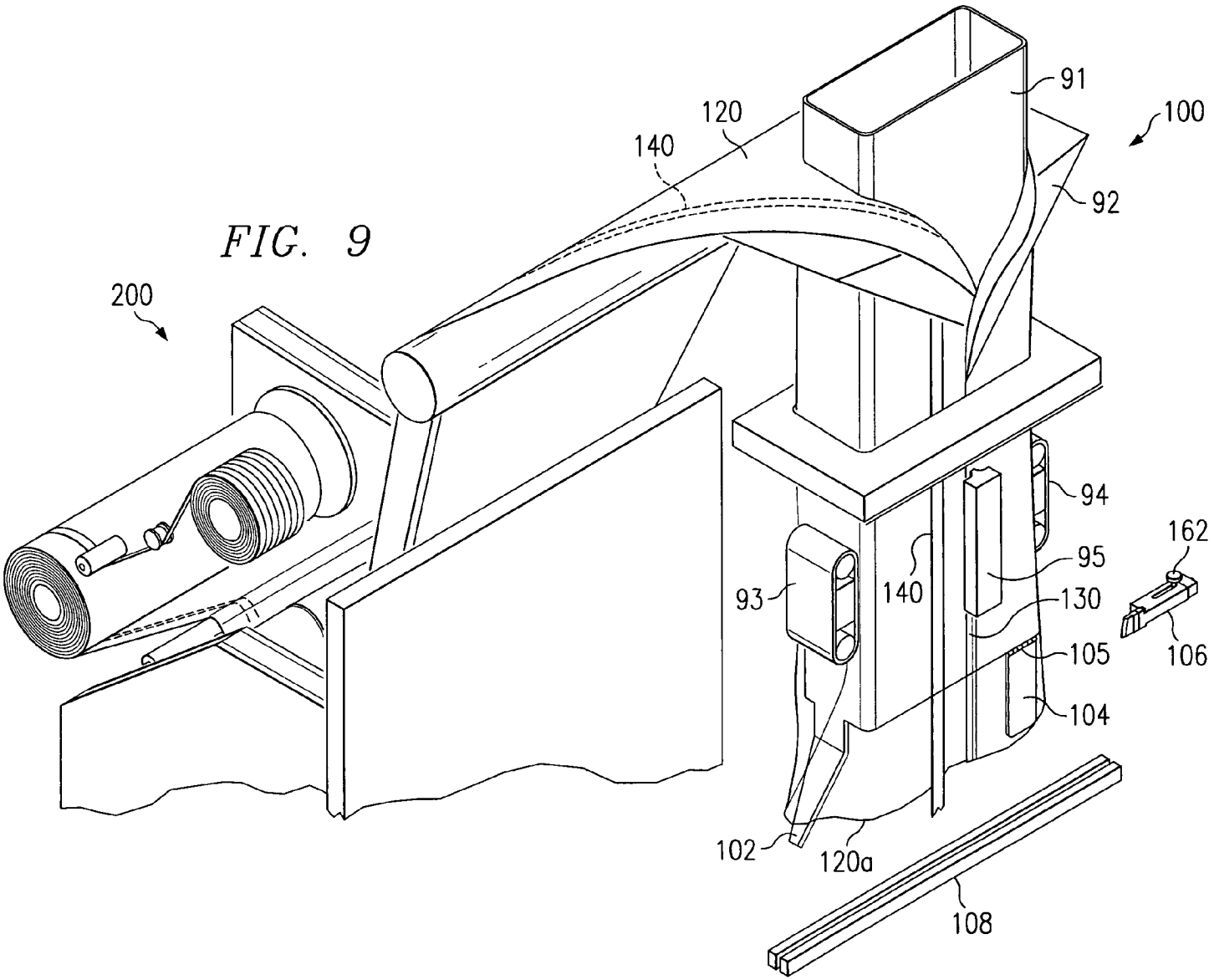
FIG. 9 is a simplified perspective view of a form, fill, and seal machine adapted to manufacture a stand-up package having an integrated reclose strip in accordance with the present invention.

Referring now to FIG. 9, in another embodiment the present invention further includes an apparatus and method for producing a stand-up package having a reclose strip incorporated therein. The apparatus for applying the reclose strip is incorporated into the supply mechanism 200 that supplies a continuous sheet of packaging material or film 120 to the vertical form, fill, and seal machine 100.

As shown in FIG. 9, the vertical form, fill, and seal machine 100 includes a forming/fill tube 91 and a former section 92 around which a sheet of packaging material 120 is directed and formed into a tubular shape in the conventional manner. While the forming/fill tube 91 illustrated in FIG. 9 is shown as having a rectangular cross-sectional shape, it is understood that the cross-sectional shape of the forming/fill tube 91 may be any of various other shapes, such as circular, oval, or square. The forming/fill tube 91 illustrated in FIG. 9 may also have a diversion plate 160, as previously described, incorporated therein.

As will be subsequently explained in greater detail, the supply mechanism 200 includes an apparatus incorporated therein, which attaches a length of reclose strip 140 to the underside of the sheet of packaging material 120 such that when the sheet of packaging material 120 is supplied to the vertical form, fill, and seal machine 100 and formed into a tubular shape in the conventional manner, the reclose strip 140 is positioned along a longitudinal axis on the outer surface of the formed tube 120A.

Figure 10:
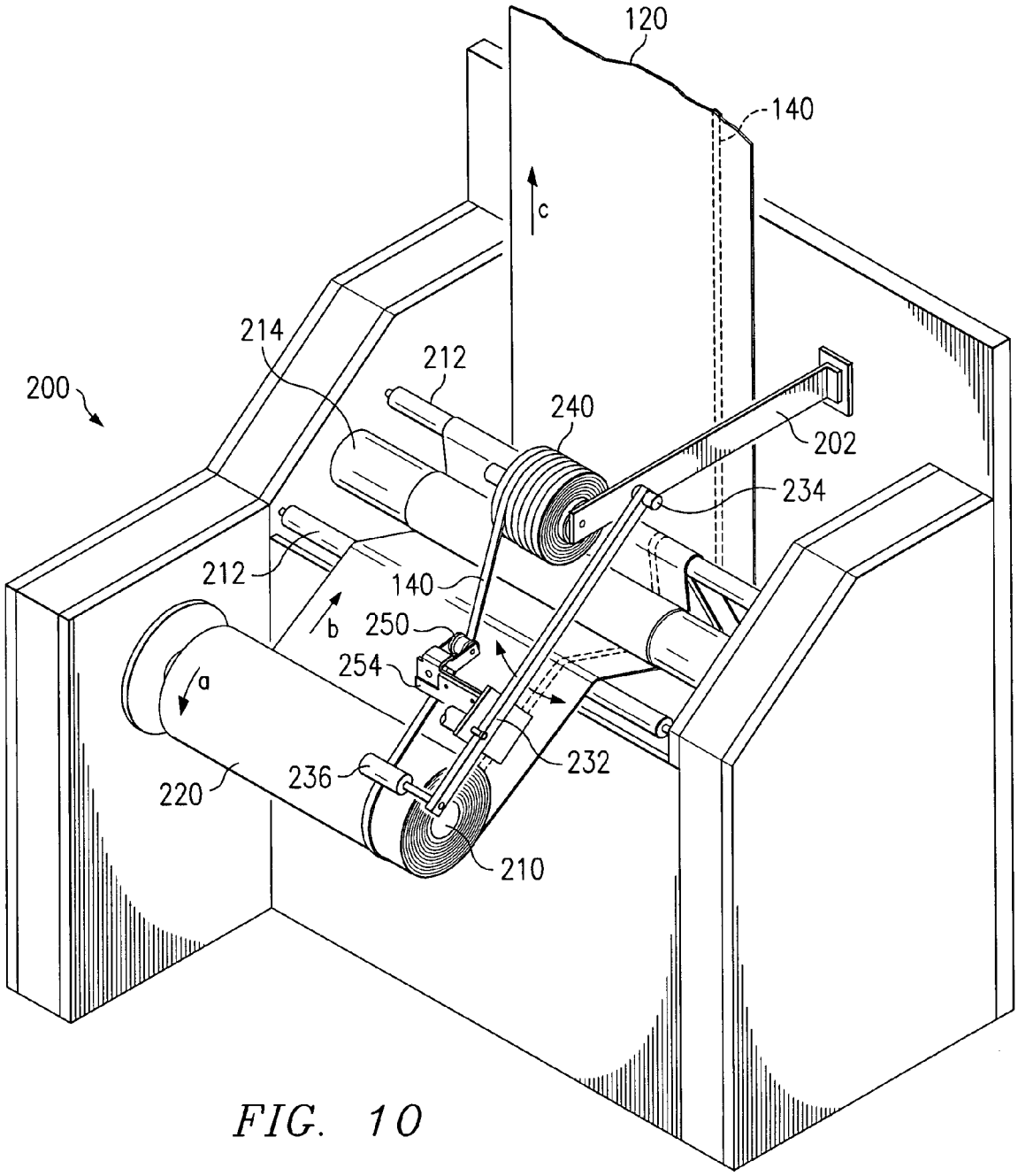
FIG. 10 is a perspective view of the apparatus for applying the reclose strip incorporated into the supply mechanism of the form, fill, and seal machine shown in FIG. 9.
Figure 11:
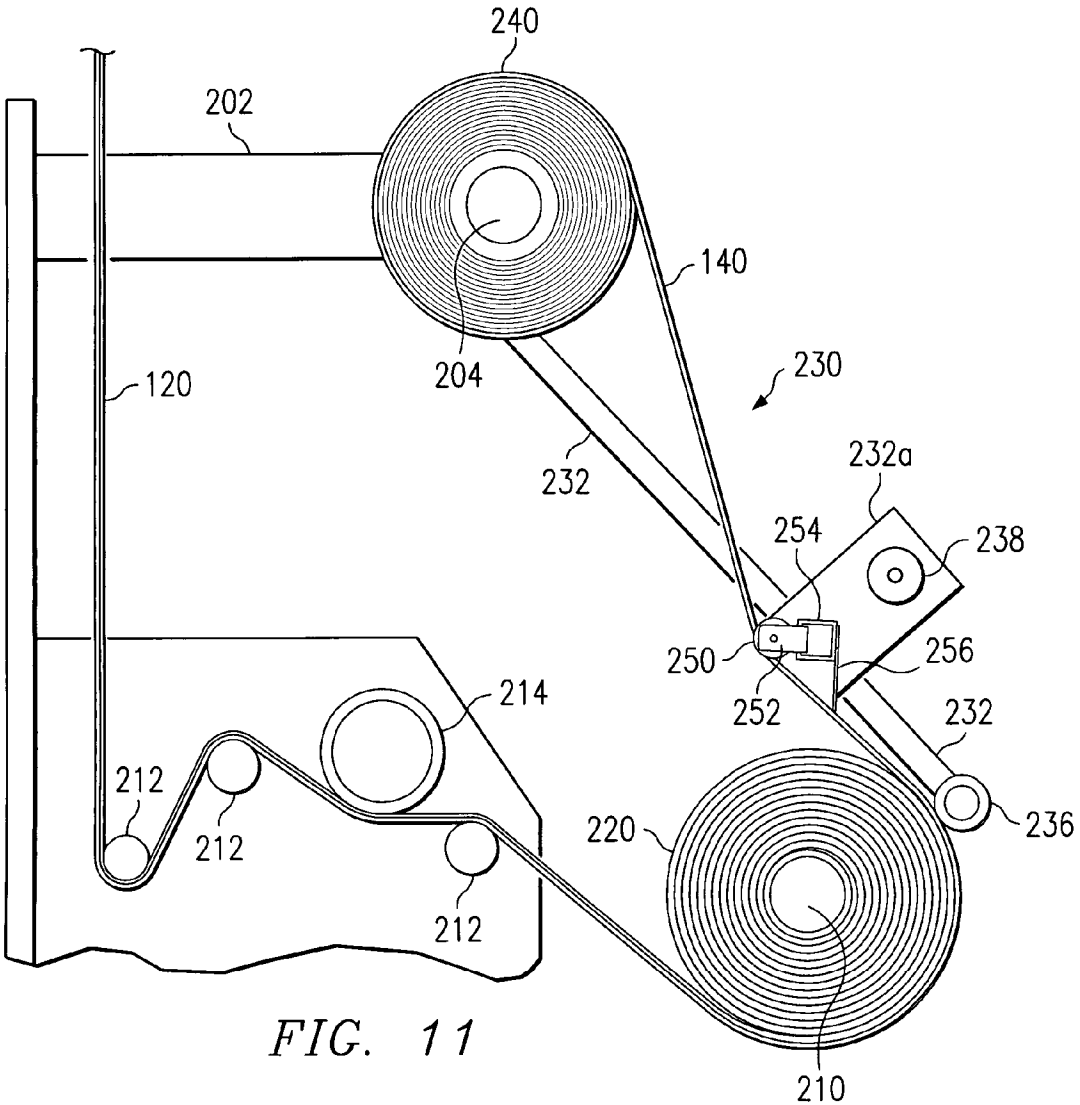
FIG. 11 is a schematic elevation view of the apparatus for applying the reclose strip shown in FIG. 10.

Referring now to FIGS. 10 and 11, an embodiment of the supply mechanism 200 depicted in FIG. 9 is shown that includes an apparatus for applying a length of reclose strip 140 to the sheet of packaging material or film 120 being supplied to the vertical form, fill, and seal machine 100. The supply mechanism 200 includes a mechanism for unrolling a sheet of packaging material 120 from a supply spool 220 so as to direct a continuous sheet towards the vertical form, fill, and seal machine 100.

For example, in accordance with the conventional art, the supply mechanism 200 may comprise a horizontal spindle 210 and a series of rollers 212, 214. The supply spool 220 is placed on the spindle 210 and a sheet of packaging material 120 is unrolled and fed through the series of rollers 212, 214 in the direction of arrows a, b, and c. The rollers 212, 214 control the speed, direction, and tension of the continuous sheet of packaging material 120 directed to the towards the vertical form, fill, and seal machine 100. For example, roller 214 might be a powered roller which advances the sheet of packaging material 120 off the supply spool 220 while rollers 212 might be idler rollers, which support, smooth or direct the sheet of packaging material 120 during its course of travel through the supply mechanism 200 and control the tension imparted to the sheet of packaging material 120 as it is directed towards the vertical form, fill, and seal machine 100. In another embodiment, both the spindle 210 and roller 214 might be a powered rollers which advance the sheet of packaging material 120 off the supple spool 220 in a synchronized manner.

Of particular note, the supply mechanism 200 of the present invention also includes an apparatus for applying a length of reclose strip 140 to the sheet of packaging material or film 120. As shown in the Figures, the apparatus includes a spool arbor 204 onto which a spool 240 of reclose strip 140 is attached, and a pivoting arm assembly 230, which directs and applies the reclose strip 140 onto the sheet of packaging material 120. As shown in the embodiment illustrated in the Figures, the spool arbor 204 and pivoting arm assembly 230 are positioned and supported by a support bracket 202, which is integrally attached to the supply mechanism 200.

The pivoting arm assembly 230 comprises a pivot arm 232 pivotally attached to the support bracket 202 by a pivot pin 234. The pivot arm 232 is free to rotate about the pivot pin 234 in the directions shown by the arrows in FIG. 10. The pivoting arm assembly 230 further includes an accessory plate 232*a* attached to the pivot arm 232 and an application roller 236 located at the distal end of the pivot arm 232. The accessory plate 232*a* includes a roller guide mechanism 250, a strip bar guide 256, an extension bar 254, and a weight assembly 238 attached thereon.

In accordance with the present invention, a length of reclose strip 140 is played out from spool 240 and applied, by means of the pivoting arm assembly 230, to the outer peripheral surface of the sheet of packaging material 120 being advanced from the supply spool 220 as described previously. The length of reclose strip 140 from spool 240 is threaded through a roller guide mechanism 250 and a bar guide 256 extending from accessory plate 232*a*, so as to position align, and apply the length of reclose strip 140 to the sheet of packaging material 120 being advanced from the supply spool 220. The application roller 236 located at the distal end of the pivot arm 232 further presses the length of reclose strip 140 onto the sheet of packaging material 120 ensuring a good bonding between the reclose strip 140 and the packaging material 120. A weight assembly 238 may be attached to accessory plate 232*a* to increase the force applied by the application roller 236 upon the reclose strip 140 and the sheet of packaging material 120 as well as stabilize the entire pivoting arm assembly 230.

Figure 12:
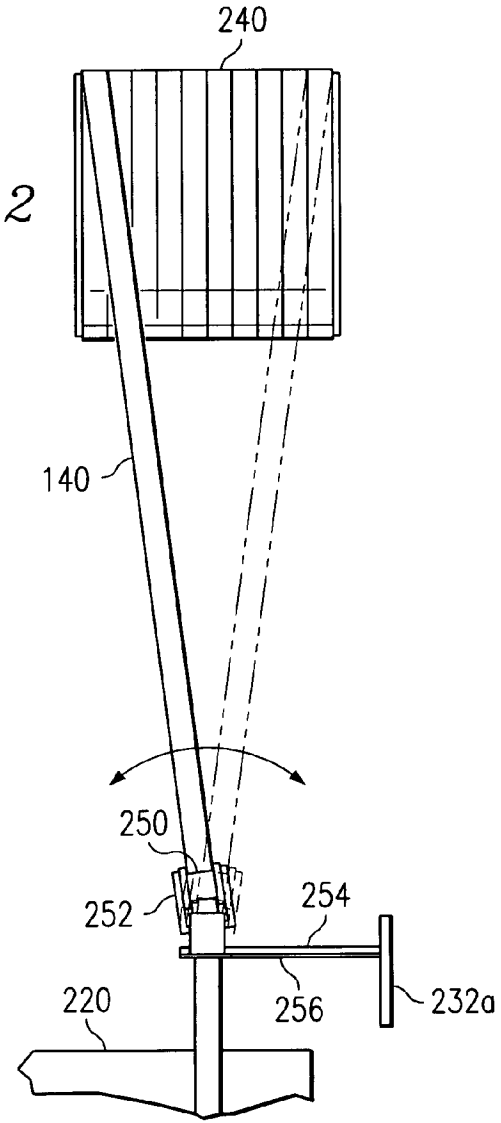
FIG. 12 is an enlarged overhead view of a portion of the apparatus for applying the reclose strip shown in FIG. 10.

While the spool 240 of reclose strip 140 utilized in the present invention could theoretically be a single wound spool, as shown in the Figures and particularly in FIG. 12, a preferred embodiment of the present invention includes a spool 240 comprised of layer of multiple windings of reclose strip 140 arranged generally adjacent to one another as illustrated. As the length of reclose strip 140 is unwound from the spool 240, it oscillates back and forth across the width of the spool as illustrated in phantom and by the arrows.

In order to smoothly accommodate the gentle oscillation of the unwinding reclose strip 140, the roller guide mechanism 250 is fitted with a guide frame 252, which is pivotally attached to the an stationary extension bar 254, extending from the accessory plate 232*a*, which in turn is attached to the pivot arm 232. The roller guide mechanism 250 may comprise a cylinder having flange elements on the outer edges that channel the lateral edges of the length of reclose strip 140. Thus, the roller guide mechanism 250 is automatically aligned with the relative angle of the length of reclose strip 140 unwinding from the spool 240 thereby smoothly guiding the length of reclose strip 140 along to the bar guide 256, which aligns the length of reclose strip 140 with the sheet of packaging material 120.

As shown particularly in FIGS. 10 and 12, the pivoting arm assembly 230 may be quickly modified to change the placement of the length of reclose strip 140 on the sheet of packaging material 120. For example, the stationary extension bar 254 can be lengthened or shortened, thereby adjusting the lateral placement of the length of reclose strip 140 on the sheet of packaging material 120.

Once attached to the sheet of packaging material 120, the length of reclose strip 140 is, thereafter, continually and automatically unwound from spool 240 and applied to the sheet of packaging material 120 by the periodic advance of the sheet of packaging material 120 from the supply spool 220 of the supply mechanism 200 as described previously. Thus, as shown in the Figures, the length of reclose strip 140 is attached to the underside of the sheet of packaging material 120 such that when the sheet of packaging material 120 is supplied by the supply mechanism 200 of the present invention to the vertical form, fill, and seal machine 100 and formed into a tubular shape in the conventional manner, the reclose strip 140 is positioned along a longitudinal axis on the outer surface of the formed tube 120A.

With reference once again to FIG. 9, the tubular shaped packaging film 120 is driven downward by an advancing mechanism (e.g., friction against rotating belts 93, 94), whereupon a heat seal bar 95 reciprocates into contact with the tubular shaped packaging film 120 imparting a vertical back seal 130 and forming a tube 120A. In accordance with the embodiment of the present invention illustrated in FIG. 9, the reciprocating heat seal bar 95 reciprocates consecutively with the advancing means. That is to say, the advancing means advances a specific length of the tubular shaped packaging film 120 and stops; whereupon the back heat seal bar 95 reciprocates imparting a vertical back seal 130. Thus, as the formed tube 120A is advanced down the forming/fill tube 91, the length of reclose strip 140 attached to the exterior of the formed tube 120A is also advanced.

Also shown in FIG. 9 are a pair of prior art sealing jaws 108 illustrated in elevation. Not shown in FIG. 9 is the sealing jaw carriage on which such sealing jaws 108 would be mounted below the forming/fill tube 91.

At the bottom of the forming/fill tube 91, a crease-forming mechanism, as previously described, comprised of two forming plates 104, a fixed or stationary tucker mechanism 106, and a tension bar 102, is installed which modifies the standard vertical form, fill, and seal machine 100 so as to produce a stand-up packages. As with previous embodiments, the forming plates 104 can swing towards each other by rotating about a hinge 105. This arrangement allows for the forming plates 104 to rotate towards one another and avoid ripping of the packaging film 120 when transverse seals are being formed below the forming plates 104 by the transverse seal jaws 108 as shown in FIG. 9.

As in previously described embodiments, the two forming plates 104 and the tension bar 102 are used to hold the formed tube 120A in tension from inside of the tube 120A. Tension is applied on the exterior surface of the formed tube 120A and in the opposite direction of the tension provided by the forming plates 104 by the tucker mechanism 106, alternatively referred to herein as a tucker bar 106, positioned between said forming plates 104. The tucker bar 106 is preferably attached to the sealing carriage for the vertical form, fill, and seal machine 100 and is adjustable along all three axes (in/out, up/down, and front/back).

Alternatively, the tucker bar 106 can be attached to the frame of the vertical form, fill, and seal machine 100 or any other point that can supports its function outside the film tube 120A. These adjustments in all three axes allow for the tucker bar 106 to be easily moved out of the way to convert the vertical form and fill machine 100 back to standard operation and is accomplished, in the embodiment shown in FIG. 9, by a tension screw 162 that can lock the tucker bar 106 in place when tightened. While the tucker bar 106 is adjustable, unlike in the prior art, it is fixed or stationary during operation.

When moved forward into position (i.e., toward the forming plates 104), the tucker bar 106 provides a crease or fold in the tube of the packaging film between the two forming plates 104. This crease is formed prior to formation of the transverse seal by the seal jaws 108. Consequently, once the transverse seal is formed, the crease becomes an integral feature of one side of the package.

As with previous described embodiments of the invention, the forming/fill tube 91 illustrated in FIG. 9 may also incorporate a diverter plate mechanism, like the one previously described and shown in FIG. 6, to keep product away from the vertical gusset areas.

The vertical form, fill, and seal machine 100 of the present invention shown in FIG. 9, thereafter operates basically as previously described in the prior art, with the sealing jaws 108 forming a lower transverse seal, product being introduced through the forming/fill tube 91 into the sealed tube 120A of packaging film (which now has a crease on one side and a length of reclose strip attached), and the upper transverse seal being formed, thereby completing the package.

This seal is subsequently cut horizontally across the traverse such that a top transverse seal is formed at the top of the filled bag below and a bottom transverse seal is formed on the tube of packaging film above. As previously describe, the packaging film during the prior art operation is typically oriented perpendicular to the longitudinal translation of the film so as to be readable by an operator of the machine as the film travels down the forming tube 91. Thus, as shown in FIG. 3*a*, this orientation provides graphics 39 on the formed prior art bag that are readable by a consumer when the formed bag is placed on a retail display shelf while resting on its bottom transverse seal 33. Conversely, in accordance with the present invention, the orientation of the graphics on the film packaging is 90° off of the typical prior art orientation, such that the graphics appear sideways as viewed by the operator of the vertical form, fill, and seal machine as the film is pulled down the forming tube 91 of FIG. 9.

Figure 13A:
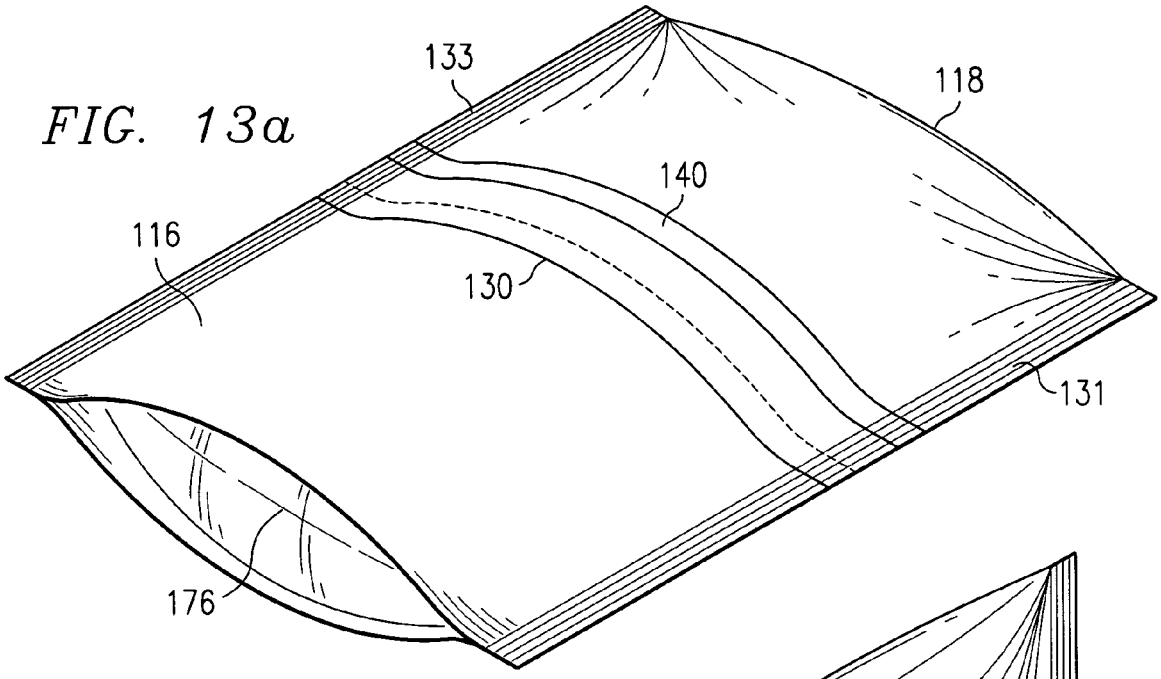
FIGS. 13*a* and 13*b* are perspective views of the vertical stand-up bag or package having an integrated reclose strip of the present invention.
Figure 13B:
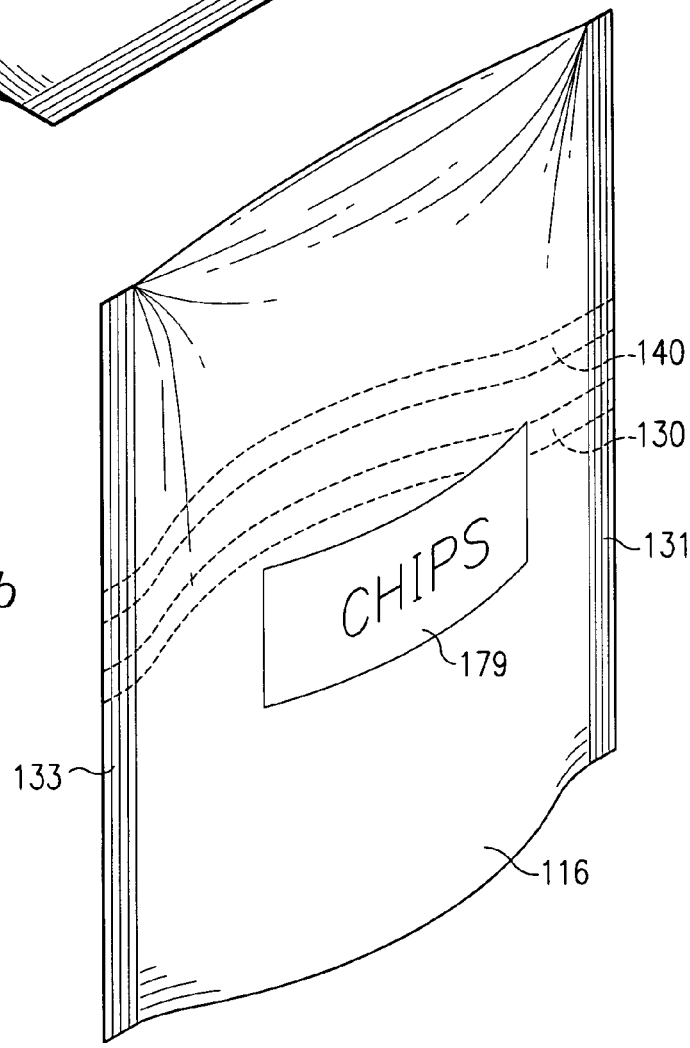

An example of the resulting formed package of the instant invention is shown in FIGS. 13*a*–13*c*, which show the outside layer of the packaging film 116 with the graphics 179 oriented as previously described. As can be seen from FIGS. 13*a* and 13*b*, the construction of the invention's vertical stand-up pouch shares characteristics with the prior art vertical flex bags shown in FIG. 3*a*. However, the transverse seals 131, 133 of the vertical stand-up bag of the invention are oriented vertically and the vertical back seal 130 is oriented horizontally once the bag stands up on one end, as shown in FIG. 13*b*. FIG. 13*a* shows the crease 176 that is formed by the tucker bar 106 and forming plates 104 and a segment length of reclose strip 140 positioned and applied on the package exterior as previously discussed in relation to FIGS. 9–12.

The reclose strip 140 used in the present invention may be of any conventional construction. For example, as shown in FIG. 13*d*, in one embodiment the reclose strip 140 may comprise a composite of several layers of material applied to the exterior surface of the package constructed of the sheet of packaging material or film 120. An adhesive 148 bonds a layer of tape 146 to the packaging material 120. On the side of the tape remote from the packaging material 120 is a second adhesive 144 which has a bonding strength of less than the first adhesive 148. The reason for this is simple. It is desired that the reclose strip 140 remain bonded to the external surface of the packaging material 120. Therefore, the bonding strength of the adhesive 148 must be greater than that of 144. Otherwise, the reclose strip 140 would peel off of the package when it adhered to a second surface. Because the adhesive 144 is of less peel strength than the adhesive 148, a peel strip 142 is bonded to the adhesive 144 and serves the purpose of preventing premature bonding of the reclose strip 140 to undesired surfaces.

In typical use, the resulting vertical stand-up pouch or package having an integrated reclose strip shown in FIGS. 13*a* and 13*b* is opened by cutting or tearing the top portion 118 of the package to provide an opening allowing the user to retrieve the contents of the package or a part thereof. Oftentimes, not all the contents of a package is consumed at one time and thus the desire to close and reseal the package is achieved where the package is manufactured according to the above discussed procedure. As shown in FIG. 13*d*, the package may be opened to remove part of the contents and resealed to prevent moisture from causing premature deterioration of the contents; the peel strip 142 has been stripped away from the adhesive 144 and two or more folds are made in the top portion 118 of the package in a direction toward the reclose strip 140. The folded portion of the package which previously represented the side of the package away from the reclose strip 140 is adhered to the reclose strip 140 and thereby the package may be returned to a storage compartment for subsequent retrieval and consumption.

While the reclose strip 140 is functional anyplace on the package, it is desirable that the reclose strip 140 be applied on the upper half of the resulting package and preferably a position about one-third of the way down from the top portion 118 of the resulting package. Placing the reclose strip 140 on the lower half of the bag could cause the user to crush the contents remaining in the bag when it is resealed. However, the exact location of the reclose strip 140 depends upon the goods being packaged.

Thus, as shown by comparing FIGS. 3*a*–3*c* with FIGS. 13*a*–13*c*, the major differences between a prior art package and this embodiment of Applicants' package are that a crease 176 is formed on one side (which later becomes the bottom of the formed package) using the fixed mechanism described, that a length of reclose strip 140 is attached to the exterior of the formed package using the apparatus incorporated into the supply mechanism 200 described, and that the graphics on the packaging film used by the invention are oriented such that when the formed package is stood onto its end with the creased end generally at the bottom, the graphics are readable by a consumer and the integrated reclose strip is oriented generally parallel to the top of the package.

As noted previously, the added ability to attach the length of reclose strip 140 to a package available on Applicants' invention, is not available using current vertical form, fill, and seal machine technology. This is due, in part, to the orientation of the film graphics used on the packaging film of the present invention. Since the graphics are oriented 90° from the prior art, a length of reclose strip 140 can be run longitudinally along the forming tube adjacent with the packaging film as it is being formed into a tube and subsequent package. This is not possible with the prior art, because such orientation of a vertical length of reclose strip would place such a strip in a vertical orientation once the package is formed and stood up for display The invention is further an improvement over methods for manufacturing prior art flat bottom bags. Since the tucker mechanism of Applicants' invention is stationary during bag formation, the present invention eliminates the need for moving parts that push against the film tube for the formation of a gusset. This elimination of moving parts allows for increased bag production rates, significantly lower changeover times to pillow pouch production, and significantly fewer maintenance issues.

While the invention has been particularly shown and described with reference to a preferred embodiment, it will be understood by those skilled in the art that various changes in form and detail may be made therein without departing from the spirit and scope of the invention.

What is claimed is:

1. A method for making a flexible reclosable stand-up package on a vertical form, fill, and seal machine, said method comprising the steps of:

a) advancing a continuous sheet of packaging film towards said vertical form, fill, and seal machine, wherein said packaging film has lettering oriented perpendicular to the direction of travel of said film;

b) attaching a length of reclose strip to a surface of said advancing sheet of packaging film along the longitudinal axis of said sheet of packaging film said reclose strip having an adhesive layer facing away from said surface;

c) feeding said packaging film into said vertical form, fill, and seal machine;

d) forming said packaging film into a tube on said vertical form, fill, and seal machine and forming a longitudinal seal, wherein said surface of packaging film having said reclose strip attached thereto is situated on the exterior of said tube;

e) forming a vertical crease in said tube of packaging film prior to sealing said tube traversely;

f) forming a first traverse seal on said tube, said first traverse seal sealing all layers of said tube together, wherein said first traverse seal includes a portion of said vertical crease;

g) dropping a product into a partially formed package created by steps a) through f);

h) forming a second traverse seal on said tube, said second traverse seal sealing all layers of said tube together, wherein said second traverse seal includes a portion of said vertical crease; and i) severing said package from said tube at said second traverse seal;

wherein said vertical crease is heat-sealed only at said first and second traverse seals.

2. The method of claim 1, further comprising:

j) standing up said package on said crease with said lettering oriented upright.

3. The method of claim 1, wherein said length of reclose strip comprises a composite structure which includes a two-sided tape having a first side bonded to said surface of said sheet of packaging film by a first pressure sensitive adhesive of some strength and a second side being coated with a second pressure sensitive adhesive and covered by a peel strip, said second adhesive having the characteristic when in tension of releasing the peel strip prior to releasing the tape.

4. The method of claim 3, wherein said first pressure sensitive adhesive has a bonding strength greater than that of said second pressure sensitive adhesive, said second pressure sensitive adhesive having the characteristics of bonding to both the tape and the surface of said sheet of packaging film and in tension, releasing the packaging film before releasing the tape such that the second adhesive will remain on the tape when the surface of the packaging film separates from the second adhesive.

* * * * *